US005881900A

United States Patent [19]

Meshorer

[11] Patent Number: 5,881,900

[45] Date of Patent: Mar. 16, 1999

[54] WASTE RECEPTACLE AND GARBAGE BAG HOLDING DEVICE

[75] Inventor: Yishai Meshorer, Jerusalem, Israel

[73] Assignee: Zag Industries Ltd., Rosh Haayin, Israel

[21] Appl. No.: 843,368

[22] Filed: Apr. 15, 1997

[51] Int. Cl.[6] ..... B65F 1/06

[52] U.S. Cl. ..... 220/495.07; 220/908.1

[58] Field of Search ..... 220/407, 404, 220/908, 909, 908.1, 495.07

[56] References Cited

U.S. PATENT DOCUMENTS

| | | | |
|---|---|---|---|
| 3,392,825 | 7/1968 | Gale et al. | 220/407 |
| 3,800,503 | 4/1974 | Maki | 220/407 |
| 4,319,694 | 3/1982 | Nehrbass et al. | 220/495.07 |
| 5,294,017 | 3/1994 | Li | 220/407 |
| 5,678,723 | 10/1997 | Swift et al. | 220/495.07 |
| 5,738,239 | 4/1998 | Triglia | 220/495.07 |

*Primary Examiner*—Stephen Castellano
*Attorney, Agent, or Firm*—Mark M. Friedman

[57] ABSTRACT

The present invention relates to a waste receptacle. More particularly, the invention is concerned with providing a waste receptacle wherein a fresh plastic garbage bag appears therein automatically upon the removal for disposal of a full bag by providing waste receptacle including a hollow container having a length and a width and featuring a substantially elongated aperture, having an outer edge, formed in a lower surface of the container. The aperture also communicating with a cavity in the hollow container, as well as the cavity having an entry facing vertically. The device further includes a base unit situated beneath the container and having a recess formed in the base unit for situating a plurality of interconnected bags.

3 Claims, 8 Drawing Sheets

Fig.1
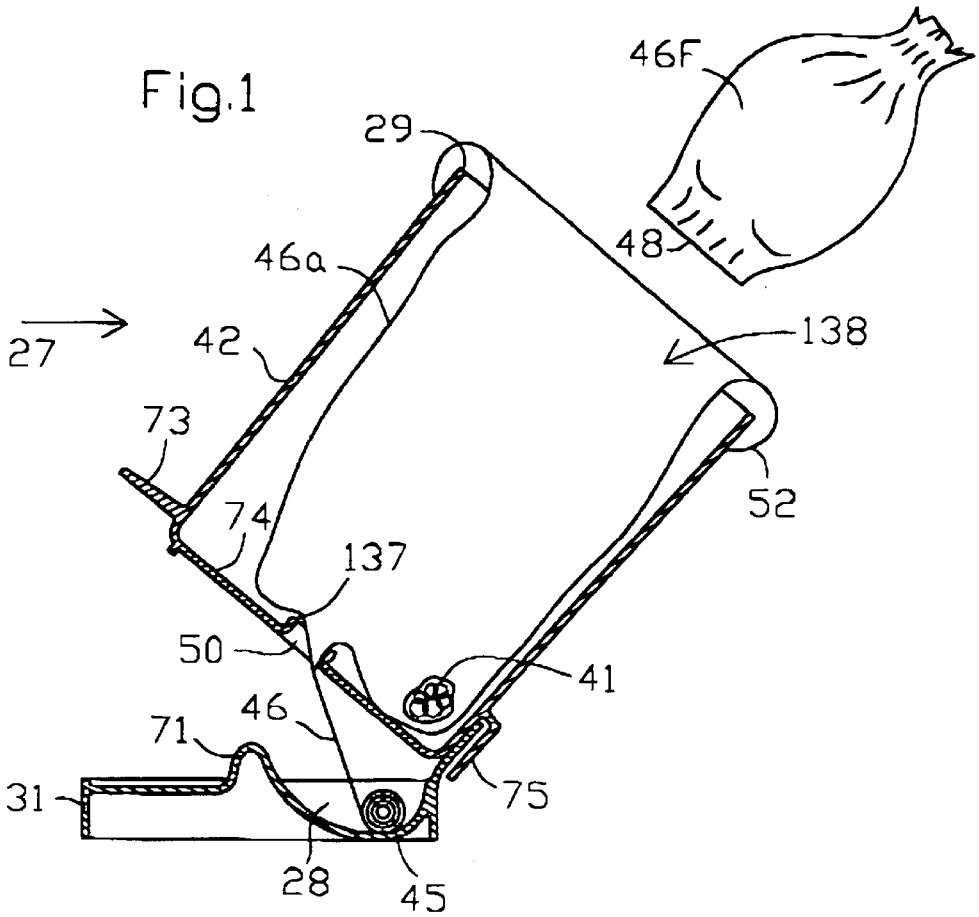
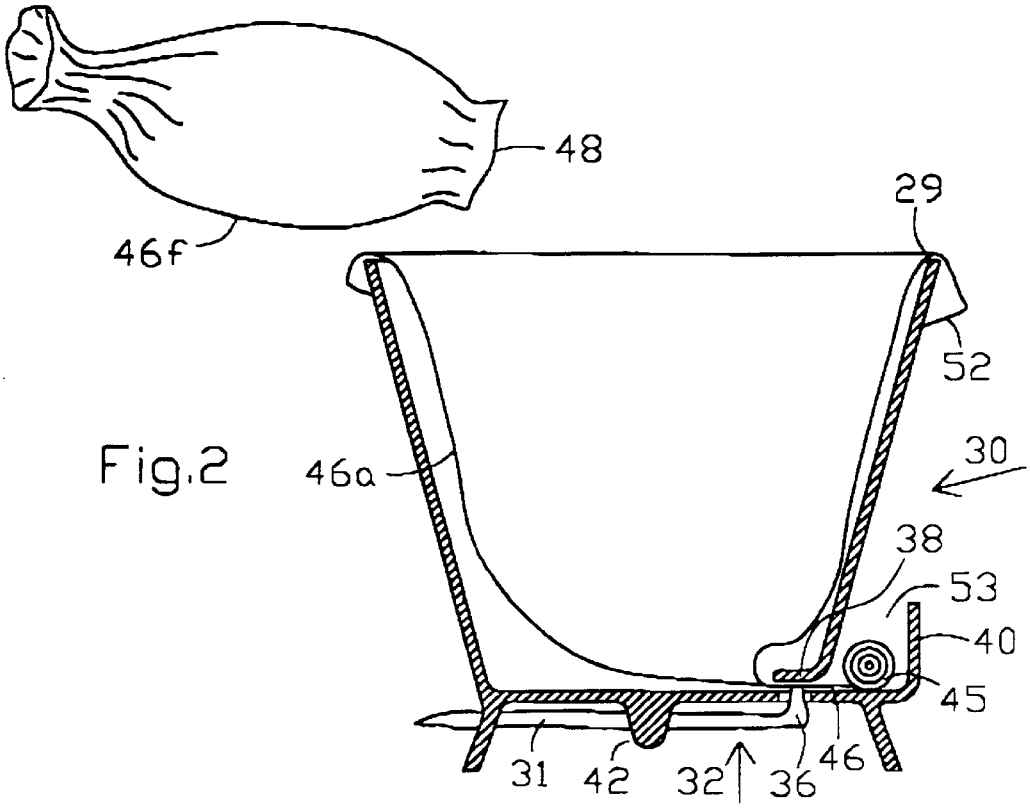
Fig.2

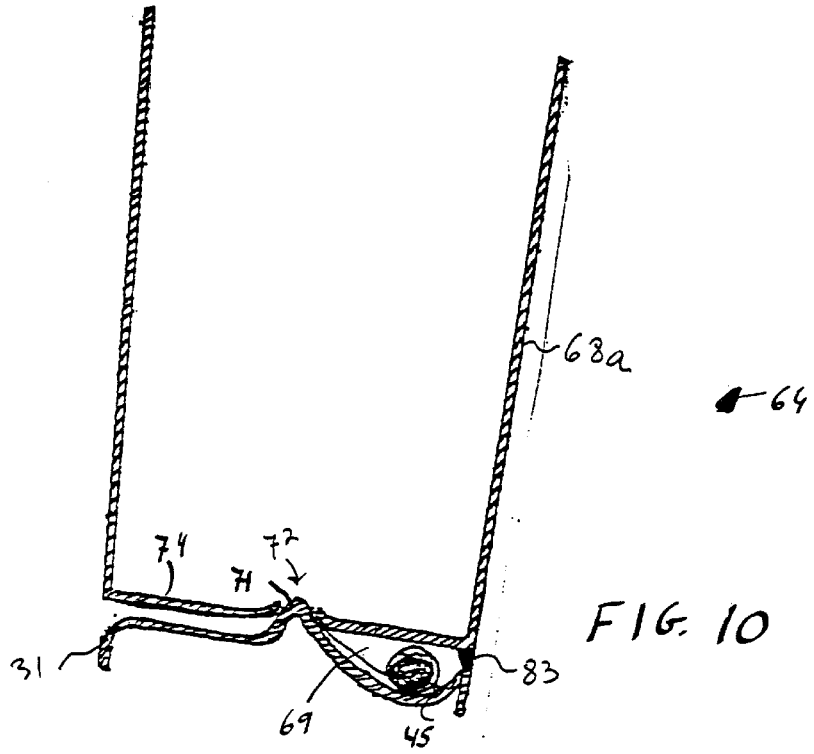
FIG. 10
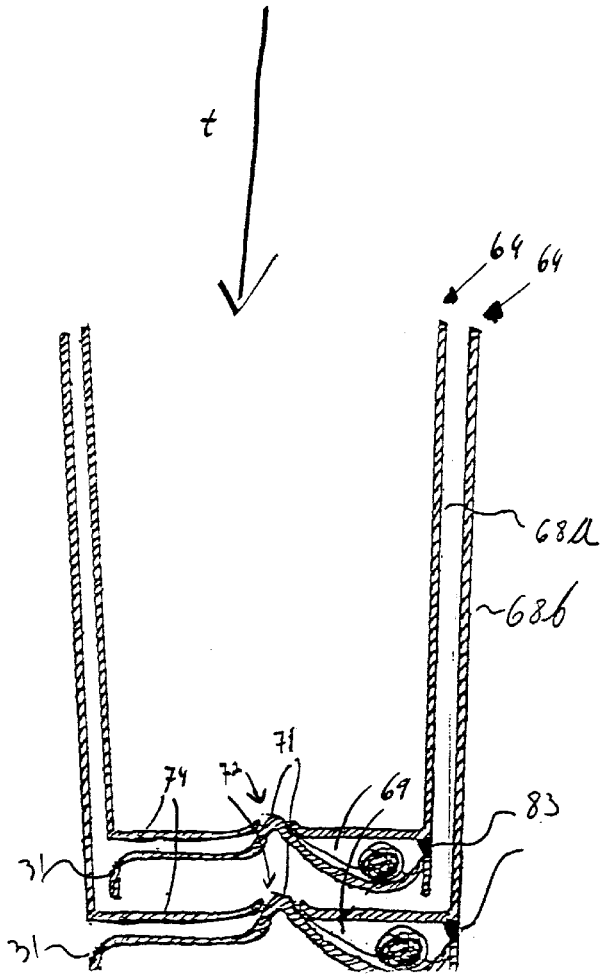

94
90
92
96
100
102
104
106
108

110
112
114
116
117
118

WASTE RECEPTACLE AND GARBAGE BAG HOLDING DEVICE

FIELD AND BACKGROUND OF THE INVENTION

The present invention relates to a waste receptacle. More particularly, the invention is concerned with providing a waste receptacle wherein a fresh plastic garbage bag appears therein automatically upon the removal for disposal of a full bag.

In developed countries where there is concern for keeping a clean, tidy and healthy home and environment, no more ubiquitous article than the waste receptacle exists. No home, office, factory or public building; no public garden, recreation area or nature reserve will be kept clean without a number of receptacles wherein people can dispose of the innumerable waste items which are generated as a result of eating, drinking, smoking and other day-to-day activities. Waste receptacles are therefore manufactured and distributed to suit all conceivable needs, ranging in size from about one liter—for use in cars and taxis, up to the 56-gallon (215 liter) size found in factories and large public kitchens.

The need for a waste receptacle is particularly felt where the waste generated is of a moist nature, such as in kitchens, or when the waste is contaminating or hazardous, such as waste from hospitals. It is, therefore, a common practice to line the inner faces of a waste bin with a plastic bag. Such bags are often made of low-density polyethylene or linear low-density polyethylene, and are manufactured and sold in packages of individually-cut bags, or in the form of rolls. Preferably, a convenient way to store such a role of bags would be in a roll of bags which is formed by a long, cylindrical, usually folded, flexible extrusion or sheet of bags. The length of the extrusion or sheet of bags is preferably partially subdivided by a pair of adjacent transverse lines every 50 to 100 centimeters, a first solid line serving to seal the base of one bag and a second, adjacent perforated line providing a convenient tear line for separating and opening the next bag.

It is common experience that changing a full garbage bag involves the following steps;

(1) removal of the full bag from the waste bin, and disposal thereof, (2) going to the location where new garbage bags are stored, separating and taking a single bag;

(3) going back to the location of the waste bin;

(4) if necessary, removing garbage which has meanwhile been deposited in the unlined receptacle;

(5) opening the new bag, which is often surprisingly difficult, as it is frequently difficult to identify which side of the bag has to be opened; and (6) fitting the new bag in the waste bin and folding the upper edge of the new bag over the rim of the waste bin.

In general, the overall tediousness of the above list, renders it understandable why individuals are not overly eager to perform such tasks. If the tasks were rendered easier, individuals would more readily agree to carry them out. It may also be noted that, in particular circumstances, the time expended in servicing waste receptacles is neither trivial nor unpaid. For example, cleaning personnel in a large public park or zoo may spend the major part of their time on servicing waste receptacles.

Dispensers for rolls of plastic bags are known, but the dispensers do little to alleviate the task of changing a full bag of waste, placing the new bag in the waste bin and the like, as described hereinabove.

It is therefore one of the objects of the present invention to obviate the disadvantages of the prior art waste receptacles, and to provide a waste receptacle which is easily and conveniently provided with a fresh plastic bag immediately upon the removal of a bag that the user wishes to replace. Such a decision may be prompted by a bag becoming heavy or having a significant quantity of refuse therein. Alternatively such a decision may be prompted by a failure of the bag being defective or any other reason due to which the user elects to replace the bag presently used.

SUMMARY OF THE INVENTION

The present invention is a waste receptacle for collecting waste, wherein a fresh plastic garbage bag appears therein automatically upon the removal for disposal of a fill bag.

According to the teachings of the present invention there is provided, a waste receptacle including: (a) a hollow container having an interior space, said interior space having an entry facing vertically; (b) a substantially elongated aperture, having an outer edge, formed in a lower surface of said container and said aperture communicating with said interior space in said hollow container; and (c) a base situated beneath said container and having a recess formed in said base for situating a plurality of interconnected bags such that a bag is insertable into said aperture.

According to further features in preferred embodiments of the invention described below, the base features a gripping surface for gripping said bags.

According to still further features in preferred embodiments of the invention described below, the gripping surface features includes transverse resilient bands for securing said container and for preventing the inadvertent displacement of said bags.

According to another embodiment the container includes a pedal.

According to yet another embodiment the includes is hingedly attached to said container.

According to yet further features in preferred embodiments of the invention described below, the device further includes a bag locking mechanism.

According to still further features in preferred embodiments of the invention described below, the aparatus further includes a lid.

According to further features in preferred embodiments of the invention described below, the device is wall mountable.

According to still further features in preferred embodiments of the invention described below, the outer edge includes at least one resilient gripper for gripping said gripping surface and sealing said aperture.

According to yet farther features in preferred embodiments of the invention described below, the container is dimensioned enabling nesting of a plurality of said containers.

According to still further features in preferred embodiments of the invention described below, the container includes a nesting ridge for situating said base.

According to another embodiment of the device, the bags are arranged in the shape of a roll.

According to the teachings of the present invention there is provided, a method for using a waste receptacle wherein a fresh plastic garbage bag appears therein automatically upon the removal for disposal of a full bag including the steps of: (a) providing a waste receptacle including: (i) a hollow container having an interior space, said interior space having an entry facing vertically; (ii) a substantially elongated aperture, having an outer edge, formed in a lower surface of said container and said aperture communicating with said interior space in said hollow container; and (iii) a base situated beneath said container and having a recess formed in said base for situating a plurality of interconnected bags such that a bag is insertable into said aperture; (b) passing a bag through said aperture; (c) pulling said bag substantially towards said opening and over said rim; and (d) displacing said container towards said base.

According to further features in preferred embodiments of the invention described below, the method further includes the steps of: (a) displacing said container substantially away from said base; and (b) inserting said bags into said recess.

According to further features in preferred embodiments of the invention described below, the method further includes the steps of: (a) verifying said bag needs replacing; (b) displacing said bag substantially towards said opening; (c) disconnecting said bag from adjacent bag; (d) disposing said bag; and (e) repeating steps (e) and (f) in claim 13.

According to still further features in preferred embodiments of the invention described below, the method further includes the steps of: (a) verifying said plurality of bags have been depleted; and (b) repeating steps (a)–(f) in claim 13.

The objective of providing a waste receptacle wherein a fresh plastic garbage bag appears therein automatically upon the removal for disposal of a full bag, is achieved by providing a receptacle for the collection of refuse, which has an attached holder for the revolvable retention of a roll of connected plastic garbage disposal bags, and an aperture formed therein passable therethrough for dispensation of a line of connected bags from the roll positioned in the holder to the inner volume of the receptacle, in a manner allowing the user to cover the inner face of the receptacle with the leading bag in the line.

It will now be realized that the novel waste receptacle of the present invention serves to:

(a) store a roll of plastic garbage bags;

(b) automatically dispense a new bag, upon withdrawal of a full bag from the receptacle;

(c) provide, in preferred embodiments, a gripping mechanism for the roll of the line of bags, thereby facilitating the easy separation of a full bag;

(d) arrange receipt of a new bag within the receptacle; and (e) orientate the new bag correctly with the waste bin opening, to make the new bag ready for use.

The invention will now be described in connection with certain preferred embodiments with reference to the following illustrative figures so it may be more fully understood.

BRIEF DESCRIPTION OF THE DRAWINGS

The invention is herein described, by way of example only, with reference to the accompanying drawings, wherein:

FIG. 1 is a cross-sectional side view of a preferred embodiment of the waste receptacle according to the invention, shown in an open configuration;

FIG. 2 is a cross-sectional side elevation of a second embodiment of the invention;

FIG. 10 is a cross-sectional side elevation of a nestable preferred embodiment with the base attached;

DESCRIPTION OF THE PREFERRED EMBODIMENTS

Figure 3:
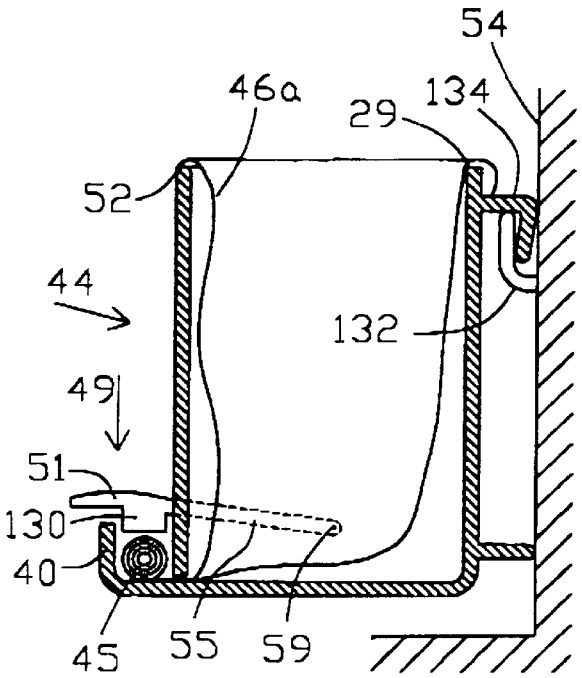
FIG. 3 is a cross-sectional side elevation of a third embodiment of the invention, wherein a gripping device acts on the roll bags.

The present invention is of a waste receptacle for the disposal of waste by providing a waste receptacle wherein a fresh plastic garbage bag appears therein automatically upon the removal for disposal of a bag which has become heavy or has a significant quantity of refuse therein or any other reason deemed sufficient by the user.

The principles and operation of a waste receptacle according to the present invention may be better understood with reference to the drawings and the accompanying description.

With specific reference to the figures in detail, it is stressed that the particulars shown herein are by way of example only and for purposes of illustrative discussion of the preferred embodiments of the present invention, and are only presented in the course of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to an ordinary artisan skilled in the art how several forms of the invention may be embodied in practice.

Referring now to the drawings, there is shown in FIG. 1 a first embodiment of a waste receptacle 27 for collecting a quantity of waste material 41. Waste receptacle 27 includes a hollow container 42 having a length and a width featuring a substantially elongated aperture 50, having an outer edge 137, formed in a lower surface 74 of container 42 and aperture 50 communicating with a cavity 138 in hollow container 42, container 42 having an entry facing vertically.

Waste receptacle 27 also includes a base unit 31 situated beneath container 42 and having a recess 28 formed in base unit 31 for situating a plurality of interconnected bags 46. A convenient form of dispensing and storing bags 46 is by placing bags 46 in recess 28 is when bags 46 are arranged in the shape of a roll 45. When bags 46 are in the shape of roll 45, recess 28 revolvably retains roll 45 of connected plastic garbage disposal bags 46 with ease.

In another embodiment (not shown), recess 28 is arranged to accommodate a number of rolls 45 in addition to roll 45 in use.

Bags 46 are typically made of low density polyethylene or linear low-density polyethylene. Roll 45 includes a long, cylindrical, folded, flexible extrusion, its length partially subdivided by a pair of adjacent transverse lines 48 every 50 to 100 centimeters. The first line (not shown) is a solid, heat-sealed seam serving to seal the base of each bag. The second line (not shown) is a perforated line adjacent to the first line and provides a convenient tear line for separating and opening the next bag thereafter.

Aperture 50 formed in container 42 allows passage of a line of connected bags 46 from roll 45 to the inner volume of container 42. After withdrawing and then separating a full bag 46*f* from an adjacent bag 46*a*, the user need only fold an open edge 52 of bag 46*a* over a rim 29 of container 42, thereby rendering new bag 46*a* ready for use.

Base unit 31 preferably includes a gripping surface 71 attached thereto, or integrally formed therewith. Gripping surface 71 is accommodated by aperture 50 formed in holder 28 and grips sheet of bags 46 when the user displaces container 42 by applying pressure, preferably with his foot, on a pedal 73. Container 42 is properly aligned in relation to base unit 31 using a guide 75.

Receptacle 27 may be molded of polyethylene, polypropylene, or a similar material. For larger sizes, a structural plastic foam is preferable. Preferably, those receptacles 27 used outdoors, are substantially made of metal, or plastic containing an ultraviolet stabilizer thereby protecting the plastic against sunlight degradation, wherein the word substantially, in this context, implies most elements of the receptacle 27 are made of metal or the aforementioned plastic variants.

A second embodiment of the invention is shown in FIG. 2, wherein a second receptacle 30 is provided with a bag locking mechanism 32. Bag locking mechanism 32 is operated by the user in order to grip bag 46 adjacent to bag 46*u* in use. Bag locking mechanism 32 shown in FIG. 2 is designed to be operated by the user's foot, thereby leaving his hands free to grip, tension and separate bag 46*u*, from roll 45 once bag 46*u* is replete with refuse.

As shown in FIG. 2, bag locking mechanism 32 includes a foot-operable lever 34, pivotally attached to receptacle 30 at 47 and including a gripping element 36. Foot pressure on lever 34 results in element 36 pressing bag 46 against a securing surface 38 of receptacle 30, thereby enabling the easy separation of bag 46 from adjacent bag 46*u*.

Roll 45 is situated in a roll holder 40 which holder 40 is provided with an upper opening 53, for the convenient replacement of a new roll 45 (not shown) once the user wishes to replace roll 45 which may occur upon the partial and/or total depletion of roll 45 being used.

Shown in FIG. 3 is a third embodiment of the present invention, wherein a waste receptacle 44 is shown with a user-operable securing mechanism 49, for temporarily preventing roll 45 revolving. As explained hereinabove, the securing of roll 45 facilitates handling a full garbage bag 46 which then may be conveniently gripped, tensioned and separated from adjacent bag 46*u*. Waste receptacle 44 further includes a gripping element 130 attached to, or integrally formed with a foot pedal 51. Pedal 51 is also attached to, or integrally formed with, a lever 55, pivoted at 59. Applying an appropriate degree of pressure on pedal 51 renders roll 45 momentarily unrevolvable for as long as the pressure on roll 45 persists. Suspending receptacle 44 is best achieved, according to this embodiment, by using a bracket 132 placed in a vertical surface such as a wall 54 and designed to accept a catch 134 attached to, or integrally formed with receptacle 44. Receptacle 44 as shown in FIG. 3, is adapted enabling suspension of receptacle 44 from vertical surface 54.

Figure 4:
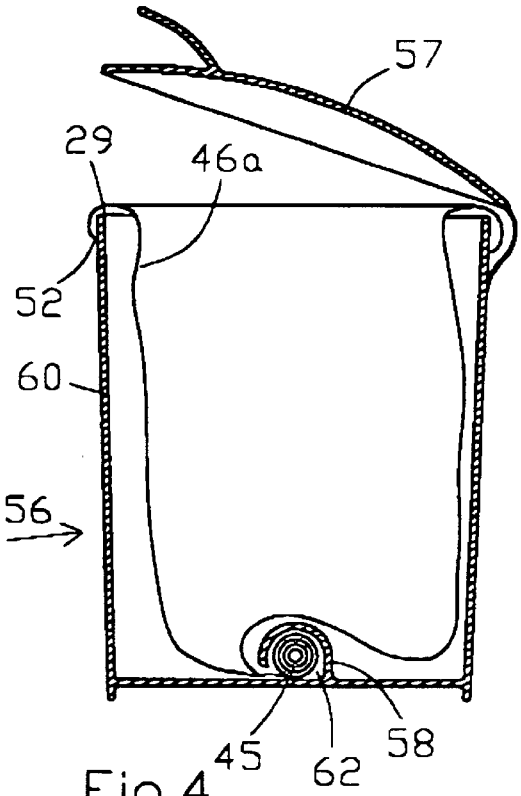
FIG. 4 is a cross-sectional side elevation of a fourth embodiment of the invention.

FIG. 4 shows a fourth embodiment of a waste receptacle 56. In this embodiment a roll holder 58 retaining roll 45 is positioned within a waste-receiving container 60. Loading of a new roll 45 is achieved by placing roll 45 axially through an aperture 62 formed in container 60. This construction is less likely to attract thieves, tamperers or vandals, and thus is well-suited to use in public areas.

Figure 5:
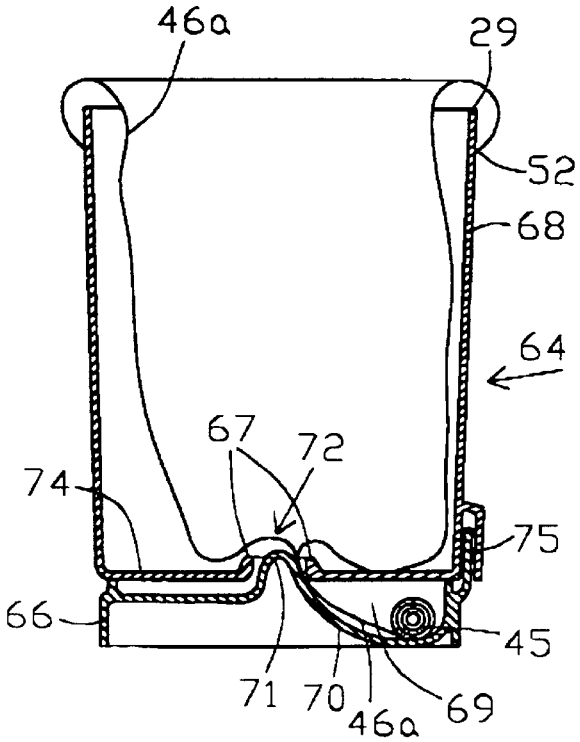
FIG. 5 is a cross-sectional side elevation of a fifth, especially preferred embodiment of the invention, provided with a base unit.

FIG. 5 depicts a fifth, especially preferred, embodiment of the present invention. A receptacle 64, similar to receptacle 27 as described hereinabove, is provided with a base unit 66, which supports a waste container 68 which container 68 is similar to container 42 described hereinabove and shown in FIG. 1. Base unit 66 is equipped with a bag holder 69 for holding roll 45 in place. Base unit 66 includes a projection 71, which projection 71 is designed to be accommodated by aperture 72 formed in bottom surface 74. When projection 71 is accepted by aperture 72, projection 71 then engages bottom surface 74 allowing ready detachment of bag 46*a* from bag 46*u*. Projection 71 is designed to create a sufficient margin between itself and aperture 72 formed in bottom surface 74 to allow passage of bag 46*a* pursuant to the user pulling bag 46*u*, thereby allowing bag 46*a* to enter container 68. Aperture 72 formed in bottom surface 74 is farther preferably formed with at least one, and preferably two as shown, upraised lip 67, such that any leakage from refuse in bag 46*u* is contained in container 68 and does not soil base unit 66 and/or recession 69. Container 68 is guided at a guide 75 to rest on top of base unit 66, and may be readily displaced for the purposes of cleaning and/or loading of a new roll 45.

Figure 6:
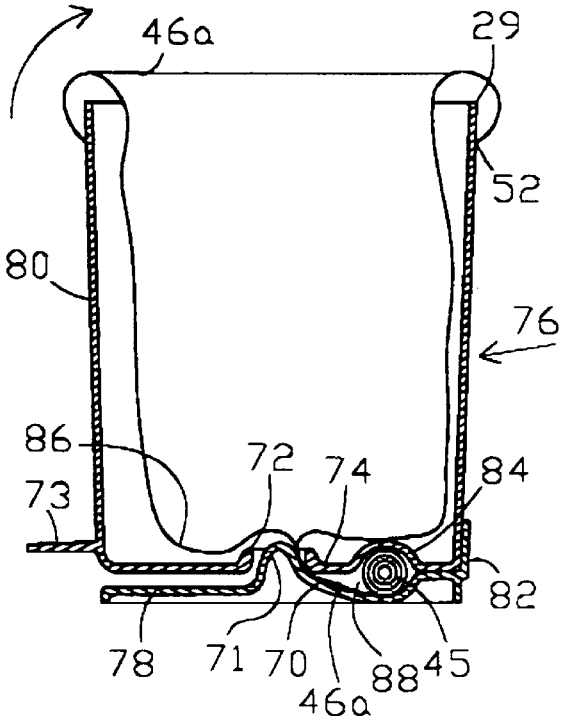
FIG. 6 is a cross-sectional side elevation of a sixth, especially preferred embodiment of the invention, provided with a hinged base unit.

A sixth embodiment is shown in FIG. 6, wherein a waste container 80 is provided with a hinge 82 proximal to a base unit 78 situated beneath container 80. Container 80 further includes a receptacle 76 similar to receptacle 64 shown in FIG. 5 and described hereinabove as well as a recession 88 situated between bottom surface 74 of container 68 and a lower surface 70 of base unit 78. Due to the partial acceptance of roll 45 in recession 88 and the lower half of roll 45 resting in base unit 78, base unit 78 may be rendered lower than base unit 66 in FIG. 5, thus economizing on the overall size and space used for container 80. In order to successfully reload bag holder 88 with a new roll 45, container 80 is displaced sufficiently, by pivoting container 80 about hinge 82 until roll 45 may be readily accepted in holder 88. Alternatively, an urging mechanism or bias (not shown) can be provided for displacing container 80 back towards base unit 86 about hinge 82, and even to provide the force needed for gripping the sheet of bags 46 and enabling easy detachment of bag 46*a* from bag 46*u*, eliminating the need for foot pedal 73 shown in FIG. 1.

Figure 8:
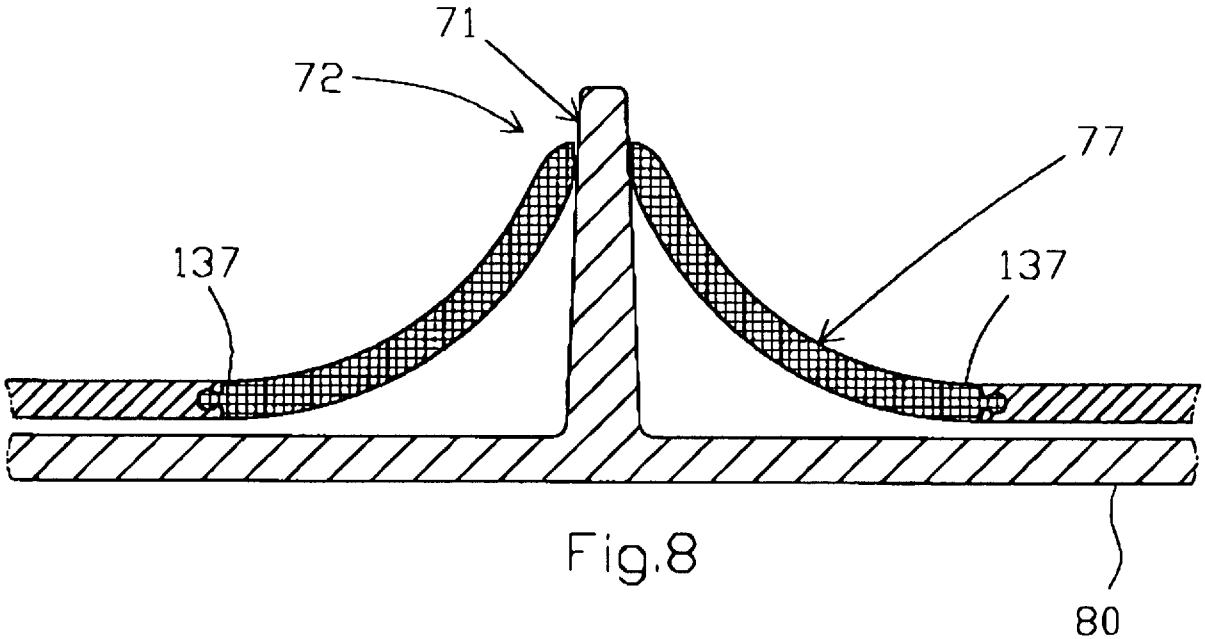
FIG. 8 is an enlarged cross-sectional side elevation of the area circled in FIG. 7.
Figure 7:
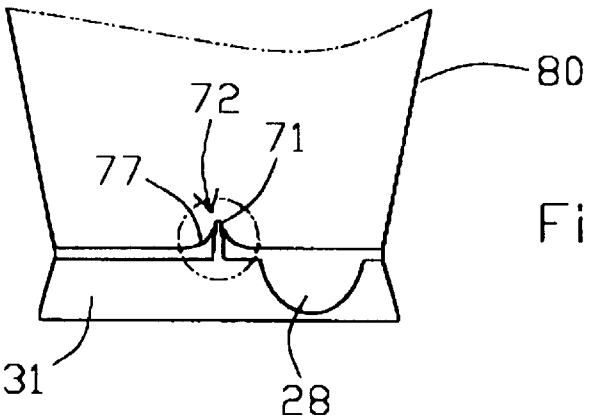
FIG. 7 is a schematic side view of a seventh, especially preferred embodiment of the invention, including a ridge and rubber grippers.

FIGS. 7 and 8 show a seventh preferred embodiment including a container 80. Similarly to previously shown embodiments, container 80 rests on base unit 31, which base unit 31 includes a holder 28 similar to holder 28 in FIG. 1. Likewise, container 80 may be displaced from base unit 31 for the purpose of loading and/or replacing roll 45 (not shown). Also similarly, container 80 includes aperture 72 formed therein as well as gripping surface 71. Container 80, further includes at least one, and preferably two as shown, resilient grippers 77 attached to, or integrally formed with, outer edge 137 of aperture 72 formed in container 80. Grippers 77 act to seal aperture 72 preventing any refuse or fluids from seeping and/or entering into base unit 31 or holder 28.

Preferably, grippers 77 are made of rubber, silicon or a different material having the same properties.

Figure 9:
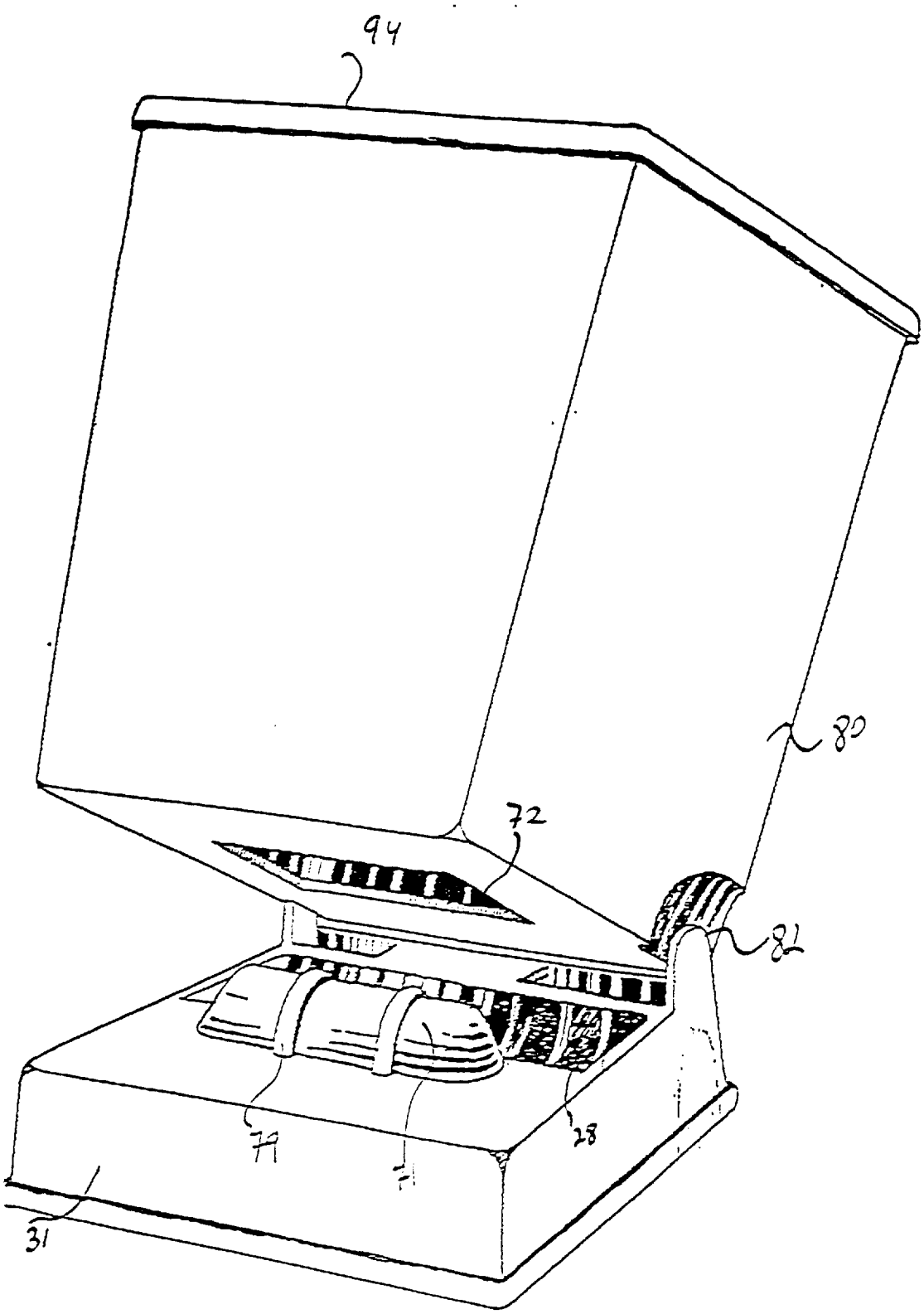
FIG. 9 is a perspective view of an eighth, especially preferred embodiment of the invention, provided with a crosswise banded projection.

Yet another configuration is shown in FIG. 9, wherein a similar container 80 including gripping surface 71 attached to base unit 31, which base unit 31 further includes at least one, two are shown, transverse bands 79 such that when container 80 is pivoted about hinge 82 thereby making aperture 72 accept surface 71 with bands 79 resulting in the application of a degree of pressure between bands 79 and aperture 72 sufficient to secure container 80 to base unit 31.

Bands 79 are used for preventing the inadvertent displacement of bags 46 as well as bands 79 potentially also serving to provide the force needed for gripping the sheet of bags 46 (not shown) to allow the ready detachment of bag 46*a* (not shown) from bag 46*u* (not shown), thereby eliminating the need for foot pedal 73 (not shown).

Preferably, bands 79 are made of a resilient material such as rubber.

More preferably, container 80 further includes a rim 94 for easier securing of bag 46*a* (not shown) being used.

Turning to FIG. 10, there is shown a cross-sectional side elevation of a preferred embodiment similar to the fifth embodiment described hereinabove and shown in FIG. 5. FIG. 10 depicts an especially preferred embodiment of the present invention wherein receptacle 64, similar to receptacle 64 in FIG. 5, is provided with a base unit 31, which base unit 31 supports a waste container 68*a* which container 68*a* is similar to another container 68*b*. Base unit 31 is similarly equipped with a bag holder 69 for holding roll 45 in place. Base unit 31, as above, includes projection 71 designed to be accommodated by aperture 72 formed in bottom surface 74 of container 68*a*. When projection 71 is accepted by aperture 72, projection 71 engages bottom surface 74 allowing the similar ready detachment of bag 46*a* (not shown) from bag 46*u* (not shown). Projection 71 is in a similar fashion, designed to create a sufficient margin between itself aperture 72 formed in bottom surface 74 to allow passage of bag 46*a* (not shown) pursuant to the user pulling bag 46 (not shown) in a similar manner, thereby allowing bag 46*a* (not shown) to enter container 68. Aperture 72 formed in bottom surface 74 is similarly formed with two upraised lips 67, such that any leakage is contained in container 68 and does not soil base unit 31 and/or recession 69. Container 68*a* is displaceable about a hinge 83 to rest on top of base unit 31, container 68*a* may also be readily displaced the purposes of cleaning and/or loading of a new roll 45.

Base unit 31 is dimensioned to enable nesting of a plurality of containers 68. Specifically, base unit 31 is dimensioned to be accommodated by container 68 thereby rendering base unit 31 nestable in container 68 for easier storage and transportation. One of the advantages of containers 68 having a nesting capability is the ability of convenient storage in warehouses while economizing in space until containers 68 are used and/or sold.

The nesting is achieved by raising container 68*a* above similar container 68*b* and then accommodating container 68*a* in container 68*b* as shown by the arrow designated "t" thus economizing the space taken up by containers 68*a* and 68*b*. The procedure described hereinabove is repeated as necessary according to the number of containers 68*a* and 68*b* to be nested.

Figures 11, 12, 13, 14:
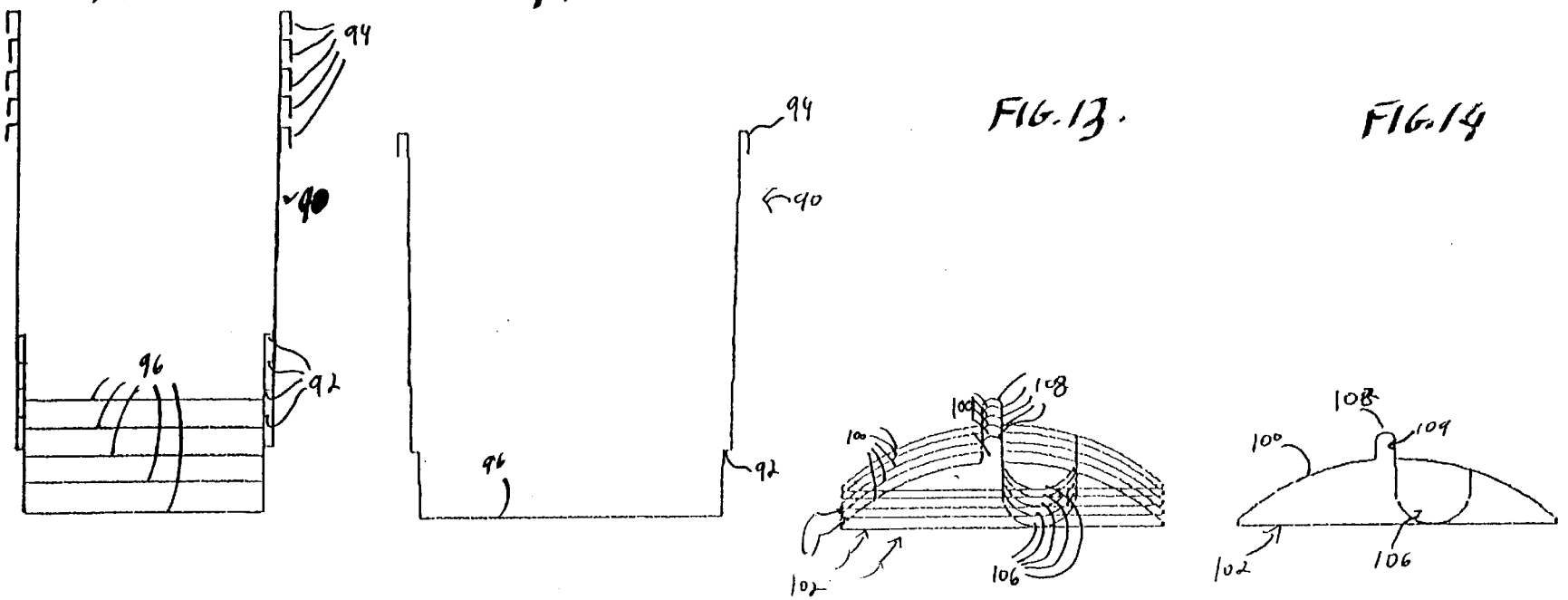
FIGS. 11–12 are schematic views of a further nestable preferred embodiment with a nesting ridge and the base having been removed.
FIGS. 13–14 are schematic views of a nestable detached base.

Another nestable configuration is shown in FIGS. 11 and 12, wherein a container 90 includes a rim 94 similar to rim 29 shown in FIG. 1, and described hereinabove in relation to the first embodiment. Container 90 also includes a bottom surface 96 having a nesting ridge 92. Furthermore, a base 100 (FIGS. 13 and 14) is detached and stored separately thereby enabling storage of spare parts without having recourse to storing containers 90 and bases 100 attached one to each other. Base 100 includes a hollow cavity 102 formed therein as well as a roll holder 106 protruding into cavity 102. Base 100 further includes a gripping surface 108 including a cavity 109 formed therein. Cavity 109 is sized to accept the upper end of gripping surface 108 when another base 108 is placed therebeneath. Due to base 100 having cavity 102 formed therein and holder 106 protruding into cavity 102 as well as gripping surface 108 having cavity 109, bases 100 are nestable in the manner shown in FIG. 13.

Figures 15, 16, 17, 18:
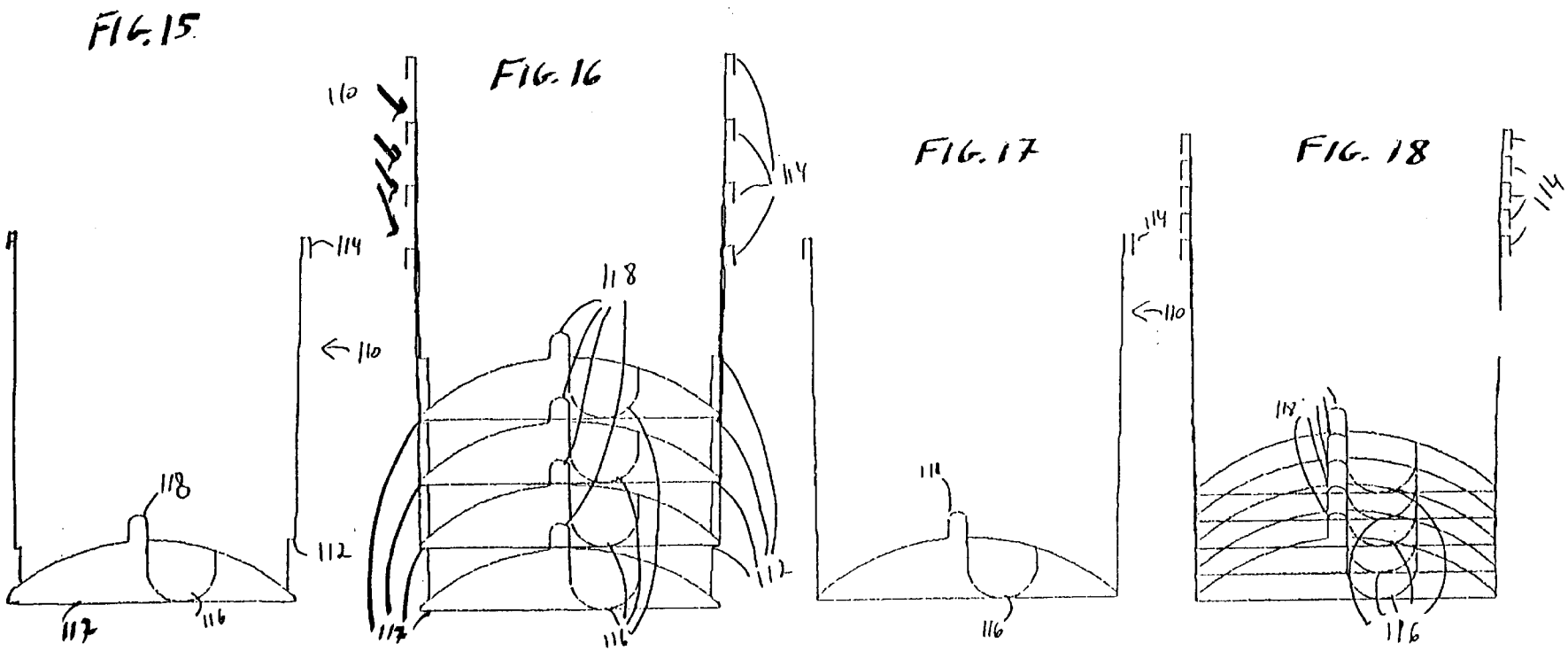
FIGS. 15–16 are schematic views of a further nestable preferred embodiment with a nesting protrusion.
FIGS. 17–18 are schematic views of a farther nestable preferred embodiment with a base.

A further nestable configuration is shown in FIGS. 15 and 16, wherein a container 110 includes a nesting ridge 112 and a rim 114. Furthermore, a base 117 similar to base 100 (FIGS. 13 and 14) is attached to, or integrally formed with, container 110. Base 117 is also dimensioned to have a smaller size than container 110 thereby rendering base 117 nestable in container 110 for easier storage and transportation. Typically, when containers 110 are nested, base 117 will rest on ridge 112.

FIGS. 17 and 18 depict yet a further configuration which is identical in all aspects to the configuration of FIGS. 15 and 16 but for the absence of nesting ridge 112 shown in FIGS. 15 and 16. Container 110 similarly includes rim 114 and base 117 is likewise attached to, or integrally formed with, container 110. Base 117 is also dimensioned to have a smaller size than container 110 thereby rendering base 117 nestable in container 110 for easier storage and transportation. Typically, when containers 110 are nested, base 117 will rest on base 117 of container 110 immediately therebeneath. Owing to the absence of any ridges, the present configuration offers an alternative and more compact nesting configuration than the configuration shown in FIGS. 15 and 16 and described hereinabove for the convenience of the user and/or retailer.

Figures 19, 20, 21, 22, 23, 24, 25:
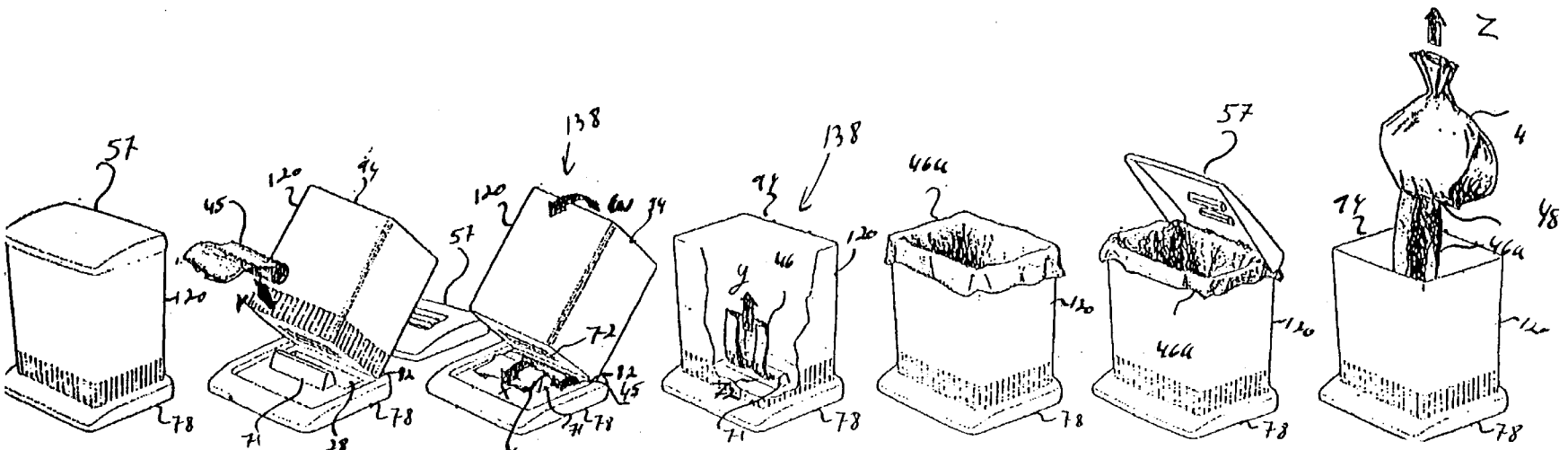
FIGS. 19–25 are perspective views of the steps of loading and removing bags from a preferred embodiment.

FIGS. 19–25 show the steps of using a waste container 120, as well as loading and replacing a bag 46*u* according to the present invention. In FIG. 19, container 120 with a lid 57 and base 78 is shown prior to being loaded. The process is achieved by performing the following steps: first, displacing container 120 substantially away from base 78. Second, inserting bags 46 into recess 28. Third, passing bag 46 through aperture 72. Fourth, displacing container 120 towards base 78 and then pulling bag 46 substantially towards opening 138 and over rim 94. Alternatively and preferably it would also be possible to pull bag 46 substantially towards opening 138 and over rim 94 and then to displace container 120 towards base 78.

Once container 120 has been used as described hereinabove, the user will verify bag 46 should be replaced and soon thereafter will displace bag 46*u* substantially towards opening 138. The user will then proceed by disconnecting bag 46*u* from adjacent bag 46*a*. The task is then completed by disposing bag 46*u*.

Occasionally the user is advised to verify that plurality of bags 46 have been depleted whereby he will proceed to perform the following steps: first, displacing container 120 substantially away from base 78. Second, inserting bags 46 into recess 28. Third, passing bag 46 through aperture 72. Fourth, pulling bag 46 substantially towards opening 138 and over rim 94 and then displacing container 120 towards base 78.

In order to further clarify the process of using the device according to the present invention with reference to the accompanying drawings a user may remove lid 57 (FIG. 20) wherein shortly thereafter container 120 is displaced about hinge 82. Immediately after container 120 is displaced, roll of bags 45 is inserted into roll holder 28. The next step is performed sheet of bags 46 (FIG. 21) being placed over gripping surface 71 in the direction generally indicated by "X". Soon thereafter, container 120 is displaced back towards base 78 in the direction generally indicated by "W". The next step is for sheet of bags 46 to be passed through aperture 72 formed in container 120 and pulled substantially upwards in the direction indicated by "Y" (FIG. 22). Thereafter, bag 46*u* (FIG. 23) is pulled over rim 94 (not shown) and preferably secured to container 120. Lid 57 (FIG. 24) is then promptly placed upon container 120 and once bag 46*u* becomes full or needs to be replaced, lid 57 is duly removed, bag 46*f* (FIG. 25) is displaced substantially upwardly in the direction indicated by "Z" until lines 48 are visible where the user tears bag 46*f* from the new bag 46*u* to be used and disposes of now full bag 46*f*. Accordingly, the user pulls bag 46*u* over rim 94 and places lid 57 back onto container 120 as shown in FIG. 24. Once roll 45 is depleted, the user will repeat the process shown in FIGS. 19–15 and described hereinabove.

It will be evident to those skilled in the art that the invention is not limited to the details of the foregoing illustrated embodiments and that the present invention may be embodied in other specific forms without departing from the spirit or essential attributes thereof The present embodiments are therefore to be considered in all respects as illustrative and not restrictive, the scope of the invention is indicated by the appended claims rather than by the foregoing description, and all changes which come within the meaning and range of equivalency of the claims are therefore intended to be embraced therein.

It will be appreciated that the above descriptions are intended only to serve as examples, and that many other embodiments are possible within the spirit and the scope of the present invention.

What is claimed is:

1. A waste receptacle comprising:

(a) a hollow container having an interior space, said interior space having an entry facing vertically;

(b) a substantially elongated aperture, having an outer edge, formed in a lower surface of said container and said aperture communicating with said interior space in said hollow container; and (c) a base situated beneath said container and having a recess formed in said base for situating a plurality of interconnected bags such that a bag is insertable into said aperture, said base including a gripping surface for gripping said bags, said gripping surface including transverse resilient bands for securing said container and for preventing the inadvertent displacement of said bags.

2. The device of claim 1, wherein said base unit is hingedly attached to said container.

3. The device of claim 1, wherein said container is dimensioned enabling nesting of a plurality of said containers.

* * * * *